US010647943B2

(12) United States Patent
Patton et al.

(10) Patent No.: US 10,647,943 B2
(45) Date of Patent: May 12, 2020

(54) SYSTEMS AND METHODS FOR FORMING WAX OR WAX-LIKE CANDLES OR SHELLS

(71) Applicant: Luminara Worldwide, LLC, Eden Prairie, MN (US)

(72) Inventors: Douglas Patton, Irvine, CA (US); James LaBelle, Eden Prairie, MN (US); Jeffrey Thompson, Huntington Beach, CA (US); Xiaohua Wan, Eden Prairie, MN (US)

(73) Assignee: Luminara Worldwide, LLC, Eden Prairie, MN (US)

( * ) Notice: Subject to any disclaimer, the term of this patent is extended or adjusted under 35 U.S.C. 154(b) by 655 days.

(21) Appl. No.: 15/096,061

(22) Filed: Apr. 11, 2016

(65) Prior Publication Data

US 2016/0298055 A1 Oct. 13, 2016

Related U.S. Application Data

(60) Provisional application No. 62/145,545, filed on Apr. 10, 2015.

(51) Int. Cl.
*C11C 5/02* (2006.01)

(52) U.S. Cl.
CPC ..... *C11C 5/021* (2013.01); *C11C 5/028* (2013.01)

(58) Field of Classification Search
CPC ..... C11C 5/023
See application file for complete search history.

(56) References Cited

U.S. PATENT DOCUMENTS 1,351,599 A * 8/1920 Wolff ..... B28B 1/26 264/86
1,390,257 A * 9/1921 Dillman ..... C11C 5/021 425/218
1,857,289 A * 5/1932 Schwartz ..... A61C 13/20 249/122
1,953,978 A * 4/1934 Schmitt ..... C11C 5/021 264/275
3,702,495 A * 11/1972 Renoe ..... C11C 5/021 264/102
3,806,078 A * 4/1974 Achzehner ..... C11C 5/023 249/155
3,974,996 A * 8/1976 Violet ..... C11C 5/023 249/112
4,004,773 A * 1/1977 Binder ..... C11C 5/023 249/102
4,328,534 A 5/1982 Abe
4,551,794 A 11/1985 Sandell
5,597,300 A * 1/1997 Wohl ..... C11C 5/008 425/803
6,151,767 A * 11/2000 Gross ..... C11C 5/023 264/330
7,029,146 B2 4/2006 Kitchen
7,118,243 B2 10/2006 McCavit et al.
(Continued)

*Primary Examiner* — Joseph S Del Sole
*Assistant Examiner* — Melody Tsui
(74) *Attorney, Agent, or Firm* — Ryan S. Dean; Umberg Zipser LLP

(57) ABSTRACT

Systems and methods are described for forming wax shells for use with electric lighting devices. A template can comprise a sleeve that defines an interior space with a removable core at least partially disposed within the interior space. A modular top can be coupled to the sleeve, depending on the desired upper surface of the wax shell.

18 Claims, 9 Drawing Sheets

(56) References Cited

U.S. PATENT DOCUMENTS

| | | | | |
|---|---|---|---|---|
| 7,159,994 | B2 | 1/2007 | Schnuckle et al. | |
| 7,261,455 | B2 | 8/2007 | Schnuckle et al. | |
| 7,350,720 | B2 | 4/2008 | Jaworski et al. | |
| 7,481,571 | B2 | 1/2009 | Bistritzky et al. | |
| 7,503,668 | B2 | 3/2009 | Porchia et al. | |
| 7,824,627 | B2 | 11/2010 | Michaels et al. | |
| 7,837,355 | B2 | 11/2010 | Schnuckle | |
| 8,070,319 | B2 | 12/2011 | Schnuckle et al. | |
| 8,132,936 | B2 | 3/2012 | Patton et al. | |
| 8,789,986 | B2 | 7/2014 | Li | |
| 8,926,137 | B2 | 1/2015 | Li | |
| 9,033,553 | B2 | 5/2015 | Li | |
| 2001/0043467 | A1 | 11/2001 | Carpenter et al. | |
| 2001/0043469 | A1 | 11/2001 | Carpenter et al. | |
| 2003/0173540 | A1 | 9/2003 | Mortz et al. | |
| 2003/0198045 | A1 | 10/2003 | Kitchen | |
| 2005/0169666 | A1 | 8/2005 | Porchia et al. | |
| 2005/0207171 | A1* | 9/2005 | McCavit ..... | F21S 6/001 362/392 |
| 2005/0285538 | A1 | 12/2005 | Jaworski et al. | |
| 2006/0034079 | A1 | 2/2006 | Schnuckle et al. | |
| 2006/0034100 | A1 | 2/2006 | Schnuckle et al. | |
| 2006/0039835 | A1 | 2/2006 | Nottingham et al. | |
| 2006/0125420 | A1 | 6/2006 | Boone et al. | |
| 2006/0146544 | A1 | 7/2006 | Leung | |
| 2007/0127249 | A1 | 6/2007 | Medley et al. | |
| 2007/0223216 | A1 | 9/2007 | Jensen et al. | |
| 2007/0223238 | A1 | 9/2007 | Jensen | |
| 2007/0236947 | A1 | 10/2007 | Jensen et al. | |
| 2008/0031784 | A1 | 2/2008 | Bistritzky et al. | |
| 2008/0038156 | A1 | 2/2008 | Jaramillo | |
| 2008/0094825 | A1 | 4/2008 | Silver | |
| 2008/0130266 | A1 | 6/2008 | DeWitt et al. | |
| 2008/0150453 | A1 | 6/2008 | Medley et al. | |
| 2008/0310173 | A1* | 12/2008 | Craven ..... | F21S 6/001 362/393 |
| 2009/0059558 | A1 | 3/2009 | Smith | |
| 2010/0079999 | A1 | 4/2010 | Schnuckle | |
| 2011/0019422 | A1 | 1/2011 | Schnuckle et al. | |
| 2011/0027124 | A1 | 2/2011 | Albee et al. | |
| 2011/0110073 | A1 | 5/2011 | Schnuckle et al. | |
| 2011/0127914 | A1 | 6/2011 | Patton et al. | |
| 2011/0134628 | A1 | 6/2011 | Pestl et al. | |
| 2012/0020052 | A1 | 1/2012 | McCavit et al. | |
| 2012/0024837 | A1 | 2/2012 | Thompson | |
| 2012/0093491 | A1 | 4/2012 | Browder et al. | |
| 2012/0134157 | A1 | 5/2012 | Li | |
| 2013/0100686 | A1 | 4/2013 | Patton et al. | |
| 2013/0148353 | A1 | 6/2013 | Patton et al. | |
| 2014/0177212 | A1 | 6/2014 | Li | |
| 2014/0218929 | A1 | 8/2014 | Schnuckle et al. | |
| 2015/0109786 | A1 | 4/2015 | Li | |
| 2015/0285453 | A1 | 10/2015 | Schnuckle et al. | |
| 2015/0292698 | A1 | 10/2015 | Schnuckle et al. | |
| 2016/0047517 | A1 | 2/2016 | Li | |
| 2016/0109082 | A1 | 4/2016 | Li | |

* cited by examiner

SYSTEMS AND METHODS FOR FORMING WAX OR WAX-LIKE CANDLES OR SHELLS

This application claims priority to U.S. Provisional Application No. 62/145,545, filed Apr. 10, 2015. All extrinsic materials identified herein are incorporated by reference in their entirety.

FIELD OF THE INVENTION

The field of the invention is electric lights and candles.

BACKGROUND

The following background discussion includes information that may be useful in understanding the present invention. It is not an admission that any of the information provided herein is prior art or relevant to the presently claimed invention, or that any publication specifically or implicitly referenced is prior art.

Various electric lights are known in the art. See, e.g., U.S. Pat. No. 8,132,936 to Patton et al., U.S. Pat. No. 8,070,319 to Schnuckle et al., U.S. Pat. No. 7,837,355 to Schnuckle et al., U.S. Pat. No. 7,261,455 to Schnuckle et al., U.S. Pat. No. 7,159,994 to Schnuckle et al., US 2011/0127914 to Patton et al., U.S. Pat. No. 7,350,720 to Jaworski et al.; US 2005/0285538 to Jaworski et al. (publ. December 2005); U.S. Pat. No. 7,481,571 to Bistritzky et al.; US 2008/0031784 to Bistritzky et al. (publ. February 2008); US 2006/0125420 to Boone et al. (publ. June 2006); US 2007/0127249 to Medley et al. (publ. June 2007); US 2008/0150453 to Medley et al. (publ. June 2008); US 2005/0169666 to Porchia, et al. (publ. August 2005); U.S. Pat. No. 7,503,668 to Porchia, et al.; U.S. Pat. No. 7,824,627 to Michaels, et al.; US 2006/0039835 to Nottingham et al. (publ. February 2006); US 2008/0038156 to Jaramillo (publ. February 2008); US 2008/0130266 to DeWitt et al. (publ. June 2008); US 2012/0024837 to Thompson (publ. February 2012); US 2011/0134628 to Pestl et al. (publ. June 2011); US 2011/0027124 to Albee et al. (publ February 2011); US 2012/0020052 to McCavit et al. (publ. January 2012); and US 2012/0093491 to Browder et al. (publ. April 2012).

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

However, there is still a need for improved systems and methods for forming wax or wax-like candles or shells for use in electric lighting devices, for example.

SUMMARY OF THE INVENTION

The inventive subject matter provides apparatus, systems and methods for forming wax or wax-like shells or housings for use with electric candles or other lighting devices, preferable via injection molding.

In one aspect, devices for forming a wax or wax-like shell for use with an electric lighting device, preferably via injection molding, can include a sleeve that defines an interior space. A core can be sized and dimensioned to be inserted within the sleeve's interior space, such that the core may be disposed within the sleeve. A modular top can be configured to couple to the sleeve, such that different tops can be used with the sleeve depending on the desired upper surface of the shell. For example, a shell having a flat top could use a different top that a shell having an indented top surface.

Method for forming wax or wax-like shells using injection molding are also contemplated. Such methods can include providing a device having a sleeve that defines an interior space, a core disposed within the interior space, a modular top configured to be coupled to the sleeve, and a cap having a gate. Wax can then be fed into the interior space via the gate.

It is contemplated that the cap can further include a vent through which excess wax can exit the interior space.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

A basic process for manufacturing wax shells includes pouring wax liquid, pre-heated paraffin, into a cooking container and heating it to a desired temperature. Various additives can be added to the mixture including a wax softener, antioxidants, color pigments, and fragrance oil.

As one such example, 50 kg of wax pre-heated, wax liquid can be poured into a container and heated to 120° C. Next, the following substances can be added to the wax liquid: 1) wax softener based on specifications (note: extremely cold weather will require more softener to prevent cracking (approx. 5-20%); 2) antioxidants, up to 2%; 3) color pigment, up to 2%; and 4) fragrance oil, up to 2.5%.

Once heated, the paraffin can be poured into molds. The molds preferably comprise aluminum or other metal tubes that define an outer perimeter of the wax shell, and can include a milled top scallop shape that defines an exterior top surface of the wax shell when formed. Cold water can be used to cool the molds by allowing the cold water to fill or flow through a container processing pool where the wax molds reside. During this time, wax from each mold that is still in liquid form can be poured into a wax heater for later reuse. Once hardened, the wax shells can be removed from the molds.

A drilling machine is used to make a hole in the top of the wax shell that is the correct diameter to fit with an injection molded plastic shell. The shell can then be inserted into the wax shell. Prior to inserting the plastic shell within the wax shell, glue or other adhesive can be applied to an outer portion of the plastic shell and/or an inner portion of the wax shell to adhere the two together.

Figure 1:
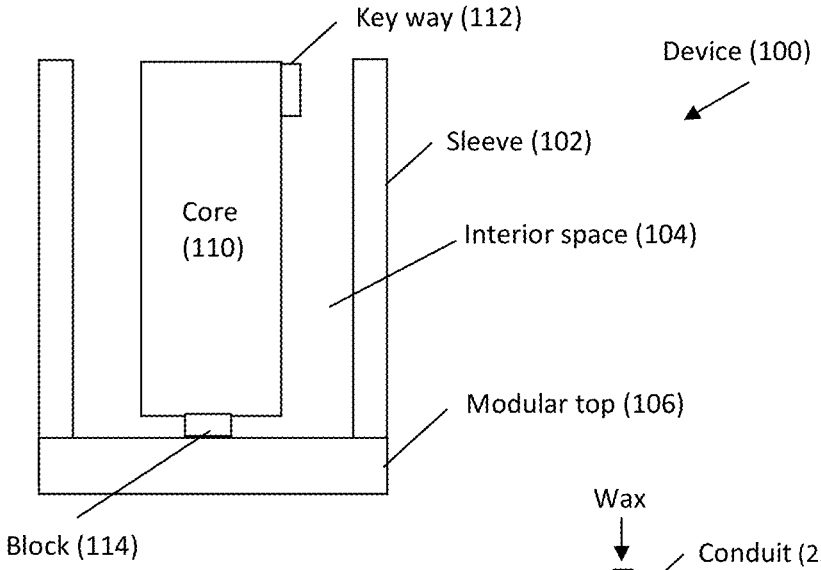
FIG. 1 illustrates one embodiment of a device for forming a wax shell.

In some contemplated embodiments shown in FIG. 1, a device 100 for forming a wax shell is shown having sleeves 102 that define an interior space 104 between the sleeves 102. A modular top 106 can be coupled to the sleeves 102, which further defines a partial perimeter of the interior space. The modular top 106 can advantageously be swapped out with one or more different tops to thereby change an upper portion of the wax shell without requiring a different tool. Contemplated modular tops include a scalloped top, a flat top, a step top, and so forth. By allowing the top 106 to be swapped out as desired, different runs of wax shells can be made and then the top changed to allow for different sets of candles to be manufactured with the same tool.

The device 100 can further include a core 110 that can be disposed within the interior space 104. The core 110 advantageously at least partially defines an interior of the wax shell and provides a hollow space in the shell once formed. The core 110 thereby eliminates the need to later drill and remove an interior portion of the shell, saving time and cost in the manufacturing process. The core 110 can advantageously include at least one keyway 112, which creates an indentation in a side of the wax shell when formed at the location of the keyway 112. This is important as it allows for a plastic core to be properly inserted by aligning a projection of the plastic core with the indentation formed in the wax shell to thereby ensure that a flame element coupled to the plastic core is properly aligned with respect to an upper surface of the shell. Exemplary flame elements and electric lighting devices are discussed in U.S. utility patent application Ser. No. 13/850,011 filed on Mar. 25, 2013.

The device 100 can further include a block 114 between the core 110 and the modular top 106 to thereby create an aperture in an upper surface of the wax shell through which a flame element can protrude, for example. The use of the block 114 eliminates the need to later drill to create a hole in the surface of the shell, saving time and money while ensuring that the holes are consistently and properly located relative to the shell's surface.

Figure 2:
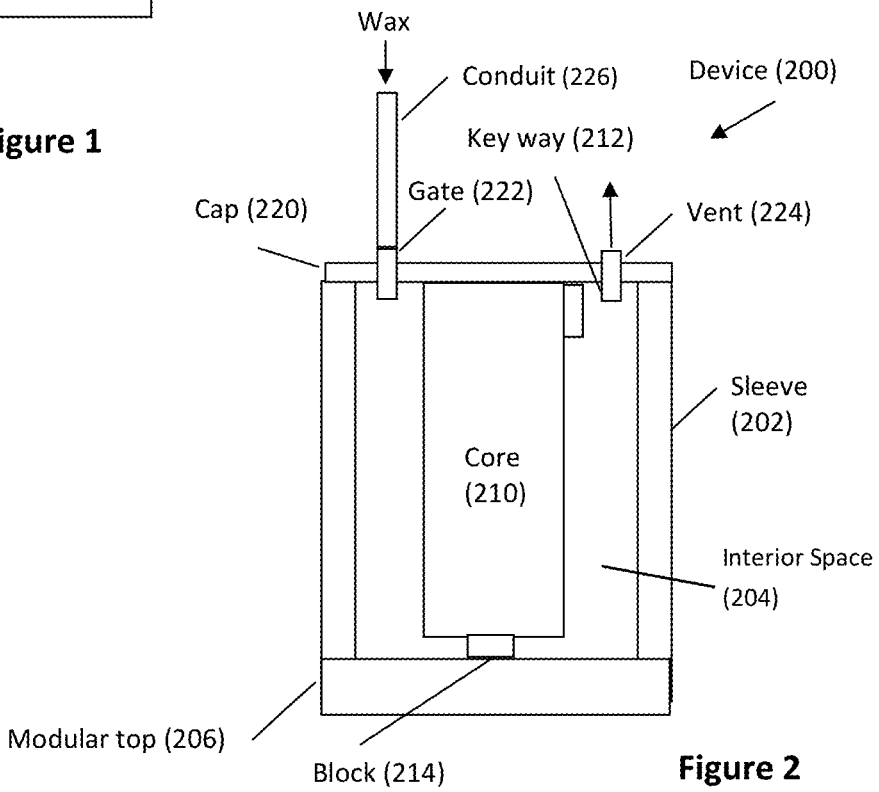
FIG. 2 illustrates another embodiment of a device for forming a wax shell.

FIG. 2 illustrates another embodiment of a device 200 for forming a wax shell. In addition to the sleeves 202 that define an interior space 204, the modular top 206, the core 210, keyway 212, and block 214, as described above with respect to FIG. 1, device 200 further includes a cap 220 having a gate 222 and a vent 224 for receipt of hot wax during manufacturing process. For example, during manufacture, hot wax can be inserted into the interior space through the gate 222 by way of a conduit 226. Excess wax can then be removed via the vent 224, as needed. With respect to the remaining numerals in FIG. 2, the same considerations for like components with like numerals of FIG. 1 apply.

Figure 3:
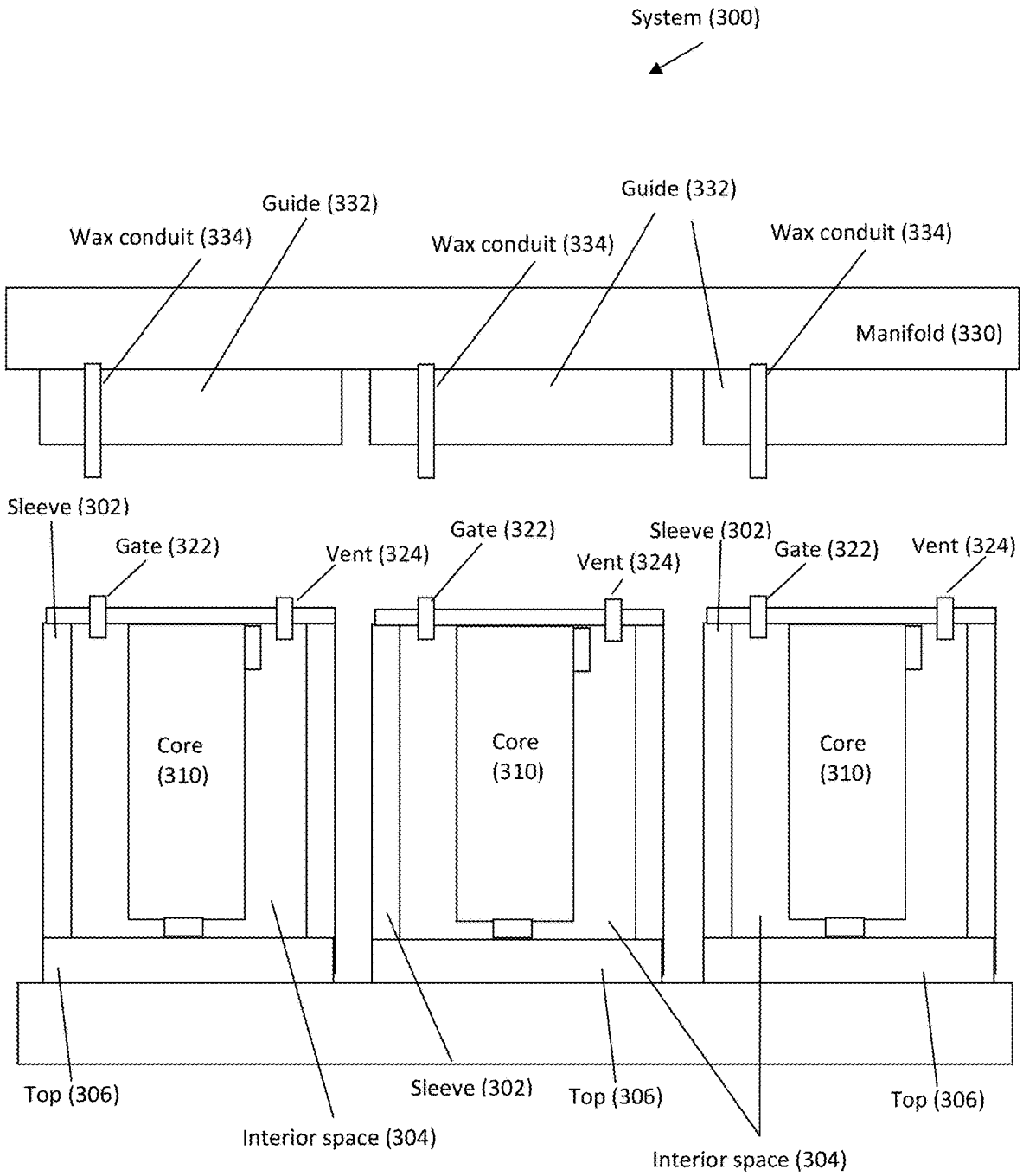
FIG. 3 illustrates one embodiment of system for forming a plurality of wax shells.

As shown in FIG. 3, a system 300 for forming a plurality of wax shells simultaneously is shown. System 300 advantageously can include a manifold 330 that causes wax to be inserted into the interior spaces 304 of a set of devices for forming wax shells. The manifold preferably includes a set of wax conduits 334 through which wax can flow into the interior spaces 304 of the devices, preferably via a gate 322. To ensure proper alignment of each wax conduit 334 with a gate 322, the manifold can further include a plurality of guides 332. In some embodiments, the guides 332 can comprise a hollow cylinder having an inner diameter that is slightly larger than an outer diameter of the devices.

Thus, for example, wax conduits 334 can be used to insert wax into each of the three devices shown. Through the use of the manifold 330, it is contemplated that the number of shells made simultaneously can be scaled up and down as needed, and could be used to create 6 packs, 10 packs and other number of wax shells simultaneously. In such embodiments, it is contemplated that the wax or other material could be pressurized to be quickly inserted into the interior area of each device. With respect to the remaining numerals in FIG. 3, the same considerations for like components with like numerals of FIGS. 1-2 apply.

Figure 4:
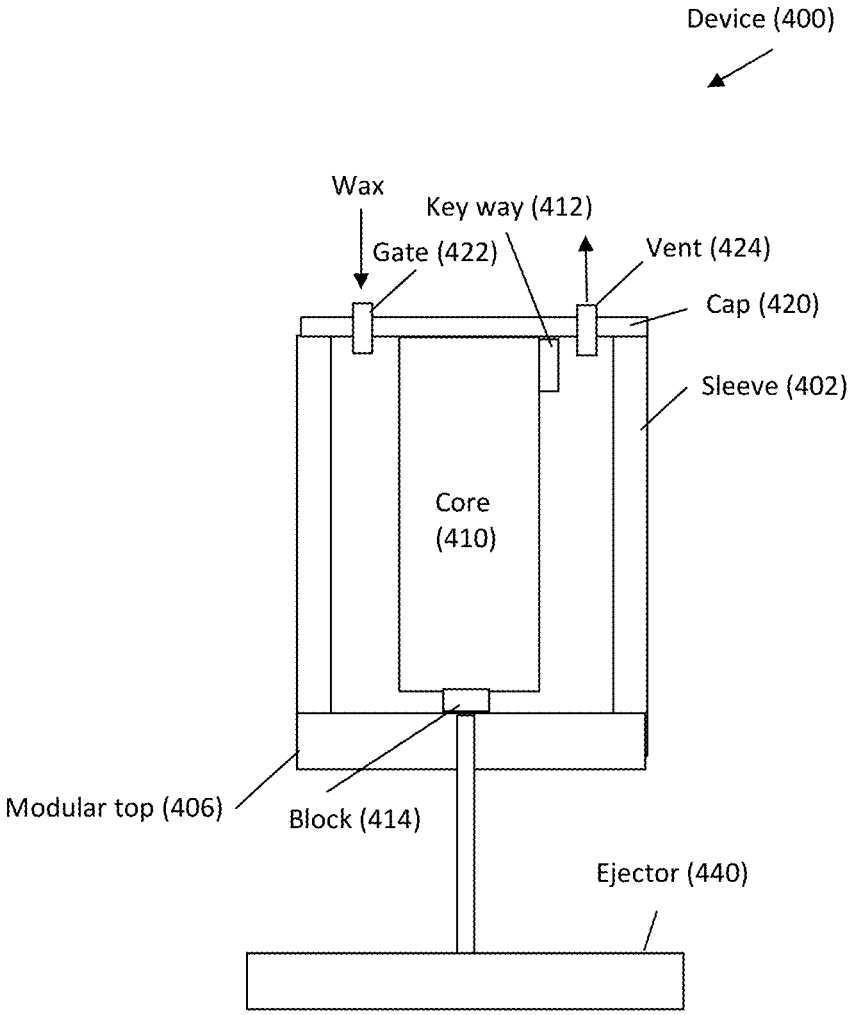
FIG. 4 illustrates another embodiment of a device for forming a wax shell having an ejector.

FIG. 4 illustrates another embodiment of a device 400 for forming a wax shell that further includes an ejector 440 that is configured to eject the wax shell and core after formation of the shell within the device 400. This advantageously allows the shell and core to be easily, and perhaps automatically, removed from the device 400. Any commercially suitable ejector could be used including, for example, a sleeve ejector. With respect to the remaining numerals in FIG. 4, the same considerations for like components with like numerals of FIGS. 1-2 apply.

Figure 5:
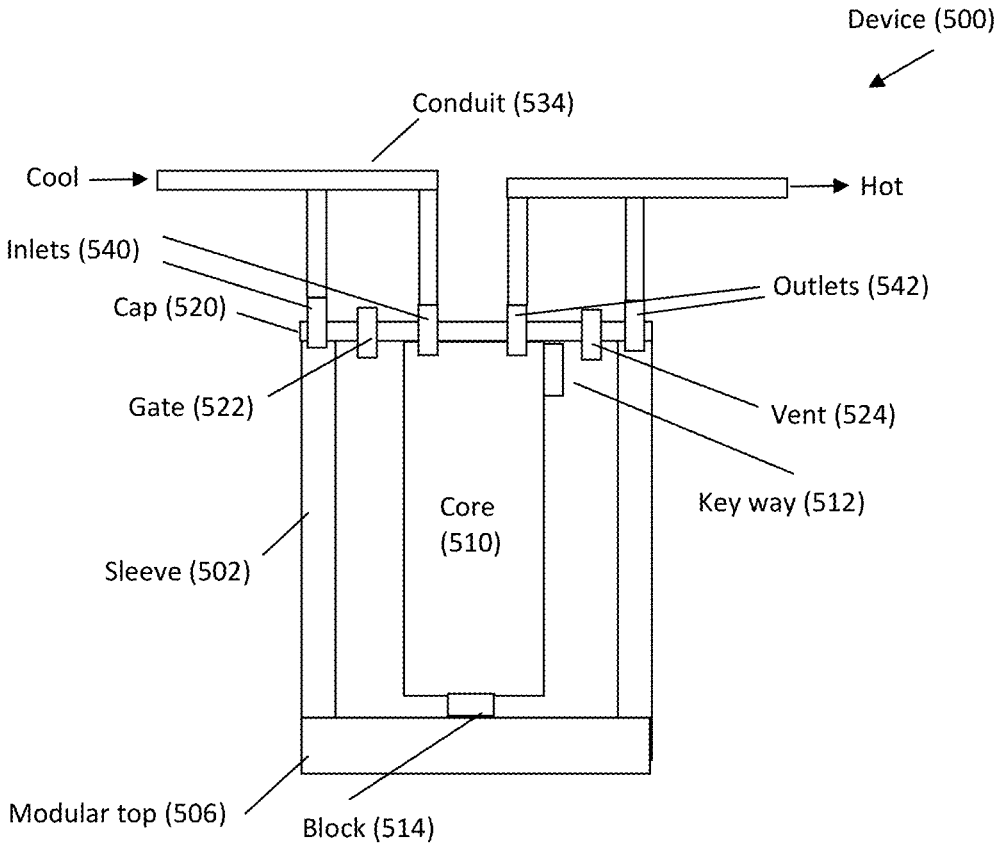
FIG. 5 illustrates another embodiment of a device for forming a wax shell.

FIG. 5 illustrates yet another embodiment of a device 500 for forming a wax shell that further includes fluid conduits (i.e., inlets 540 and outlets 542) disposed within each of the sleeve 502 and core 510 through which water or other cooling fluid can flow to thereby decrease the cooling time of the wax shell. Of course, it is contemplated that only one of the core 510 and sleeve 502 could have a fluid conduit (i.e., inlet 540 and outlet 542).

As shown in FIG. 5, a coolant, preferably water, is fed into the sleeve 502 and core 510 via inlets 540, which can exit each of the sleeve 502 and core 510 via respective outlets 542 as a heated or hot fluid based on heat exchange with the wax shell. In an alternative embodiment, the cooling fluid can flow through the sleeve 502 and then subsequently flow through the core 510, or through the core 510 first and then subsequently through the sleeve 502. Similar to how a fin increases the surface area of a heat exchanger, utilizing the core 510 as a heat exchanger substantially increases the surface area of the wax shell in heat exchange contact with a heat exchanger. Preferably, the cool liquid is circulated within the system and could be externally cooled for reuse within the system. With respect to the remaining numerals in FIG. 5, the same considerations for like components with like numerals of FIGS. 1-2 apply.

Figure 6A:
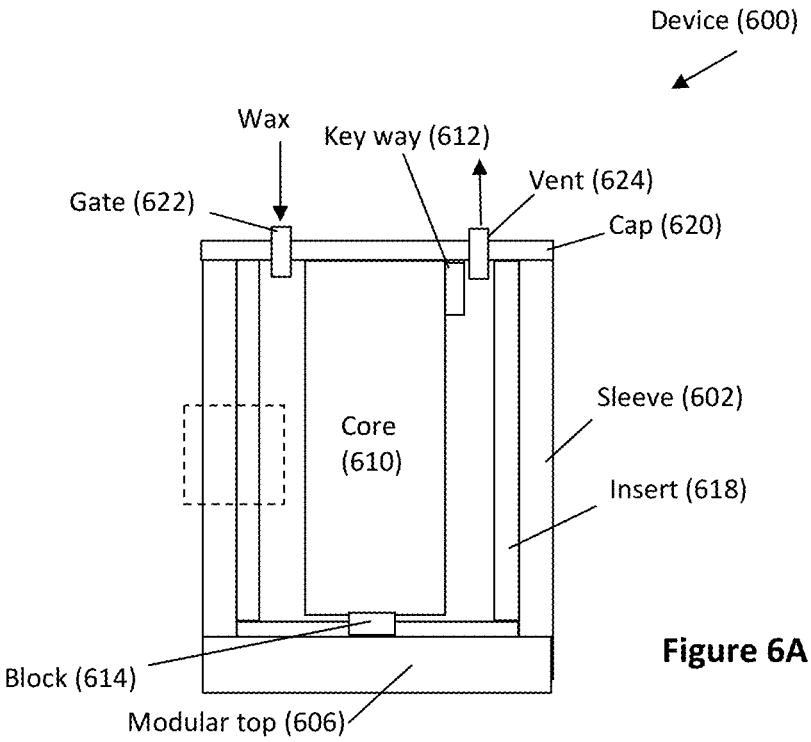
FIG. 6A illustrates yet another embodiment of a device for forming a wax shell.

FIG. 6A illustrates yet another embodiment of a device 600 for forming a wax shell that further includes an insert 618 that allows for debossing/embossing of the wax shell. Preferably, the insert 618 comprises rubber, although any commercially suitable material(s) are contemplated. With respect to the remaining numerals in FIG. 6A, the same considerations for like components with like numerals of FIGS. 1-2 apply.

Figure 6B:
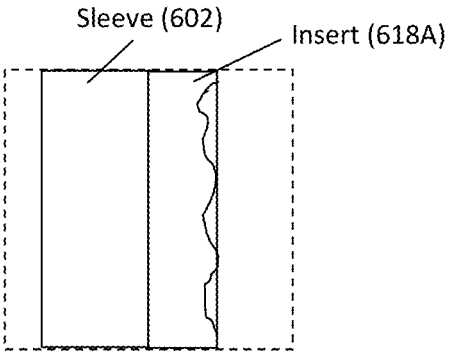
FIG. 6B illustrates an enlarged portion of FIG. 6A having an insert with one or more cavities.
Figure 6C:
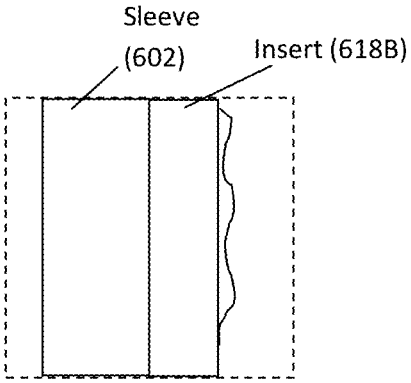
FIG. 6C illustrates an enlarged portion of FIG. 6A having an insert with one or more external projections.

As shown in FIG. 6B, an insert 618A for debossing can include one or more cavities into which the wax can be fed to form an outer design on the wax shell. FIG. 6C illustrates an insert 618B instead having external projections that create indentations on the wax shell.

It is further contemplated that a rubber insert 618 could be used having a flat surface where debossing is not desired. In such embodiment, the tool can be the same for different types of surfaces, which can reduce the overall manufacturing cost. Thus, for example, after a run of shells are made having a flat outer wall, the insert 618 can be swapped out for an insert 618A with indentations to thereby create shells having a debossed outer surface.

Figure 7:
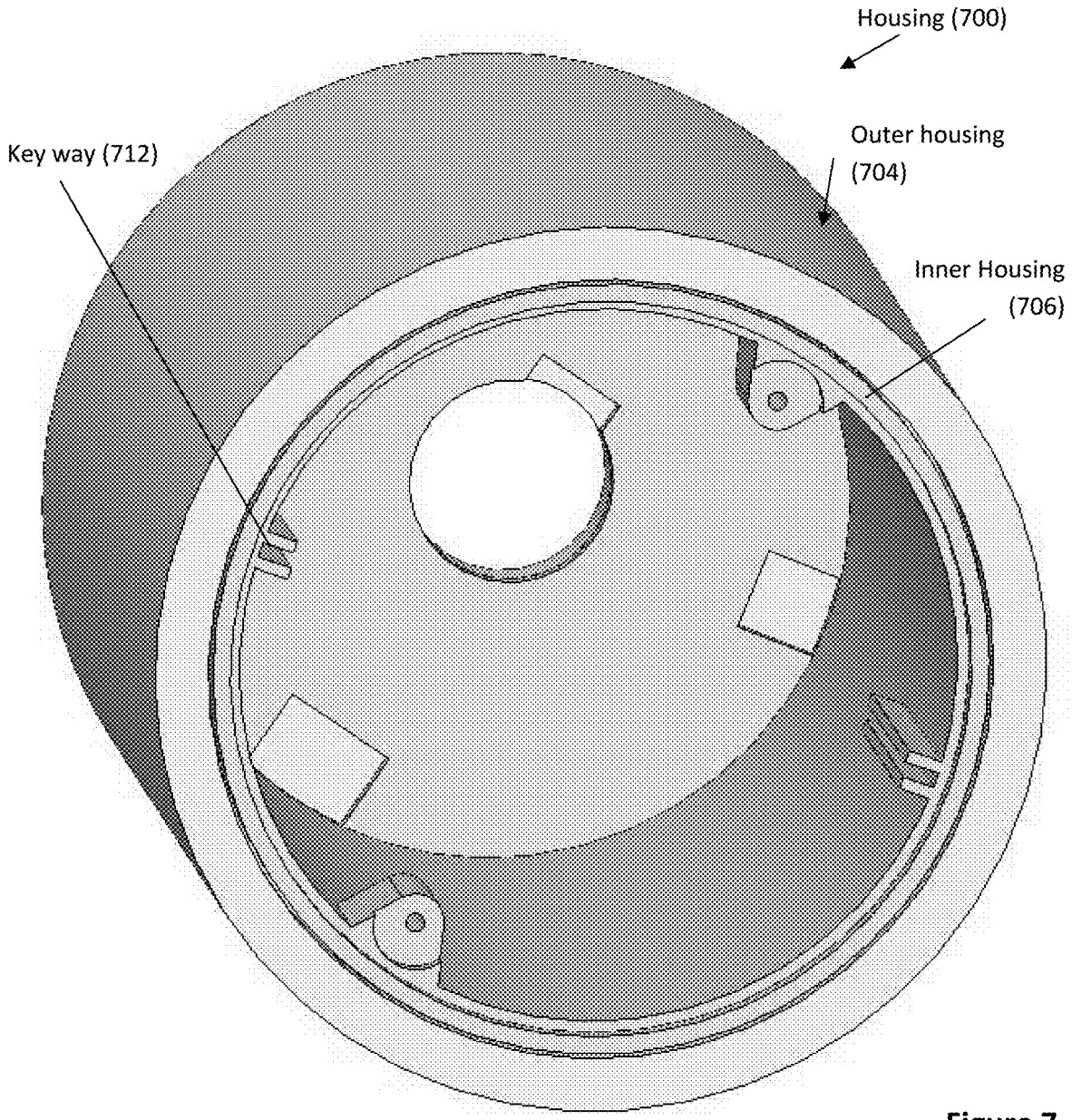
FIG. 7 illustrates a bottom, perspective view of a housing for an electric candle, having an inner housing disposed within an outer housing.
Figure 8A:
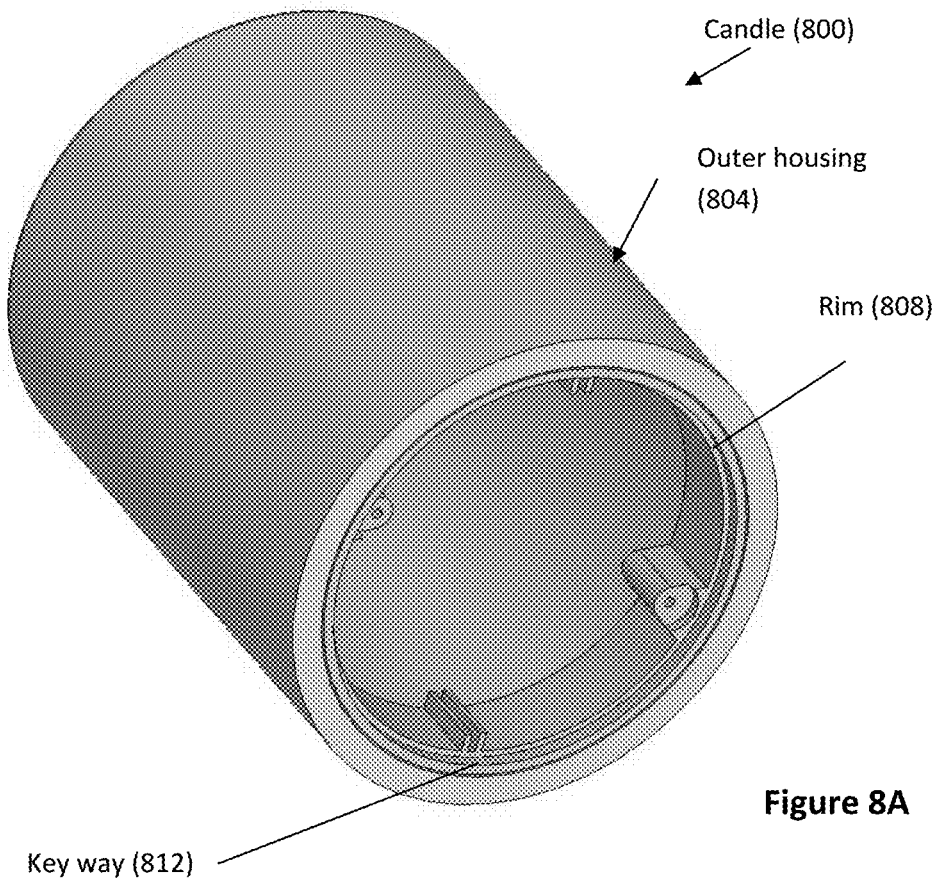
FIGS. 8A-8B illustrate perspective and exploded views of another embodiment of a housing for an electric candle having an outer wax or wax-like housing with a rim inserted within a bottom portion of the housing.
Figure 8B:
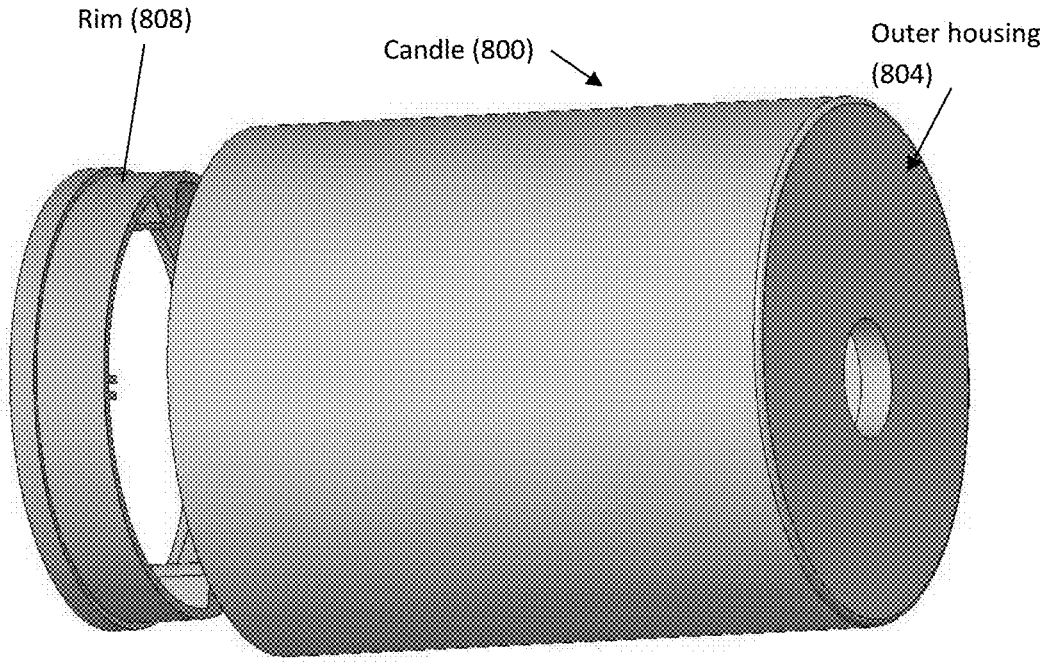
Figure 9A:
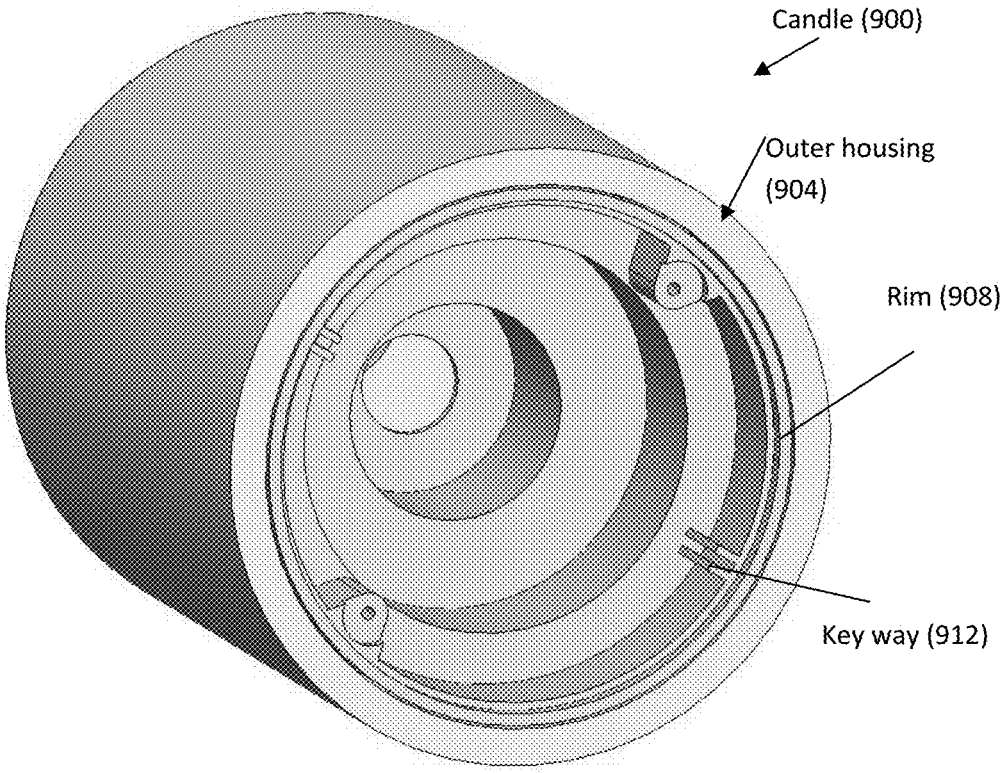
FIGS. 9A-9B illustrate perspective and exploded views of another embodiment of a housing for an electric candle having an outer wax or wax-like housing with a rim inserted within a bottom portion of the housing.
Figure 9B:
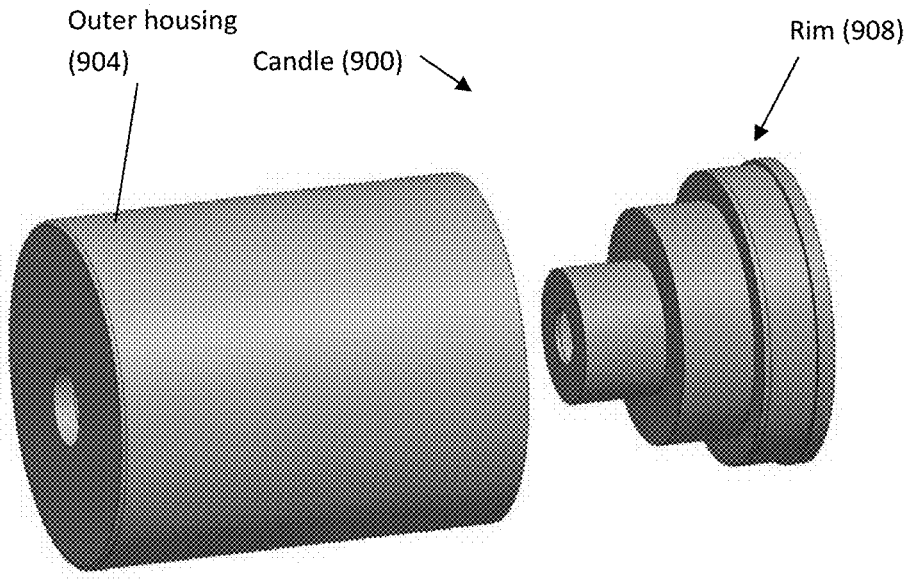

FIG. 7 illustrates an embodiment of a housing 700 for an electric candle having an inner housing 706 and an outer housing 704. The inner housing 706 can be inserted within the outer housing 704 and glued in place. Attentively, it is preferred that the pieces comprise a single piece created using dual injection-molding. The housing 700 can include one or more key ways 712 to properly orient a structure that is inserted within the inner housing 706.

FIGS. 8A-8B and 9A-9B illustrate a rim 808, 908 that can be inserted into a housing 804, 904, respectively. The rim 808, 908 can be an injection molded piece that is separately molded and then coupled to the housing 804,904, or co-injection molded with the housing 804, 904. The rim 808, 908 advantageously allows for additional structure or hardware to be coupled to the rim and held in place within the housing 804, 904. As but one example, additional structure can be coupled to the rim 808, 908 via screw or other fasteners into holes in the rim 808, 908.

Figure 10A:
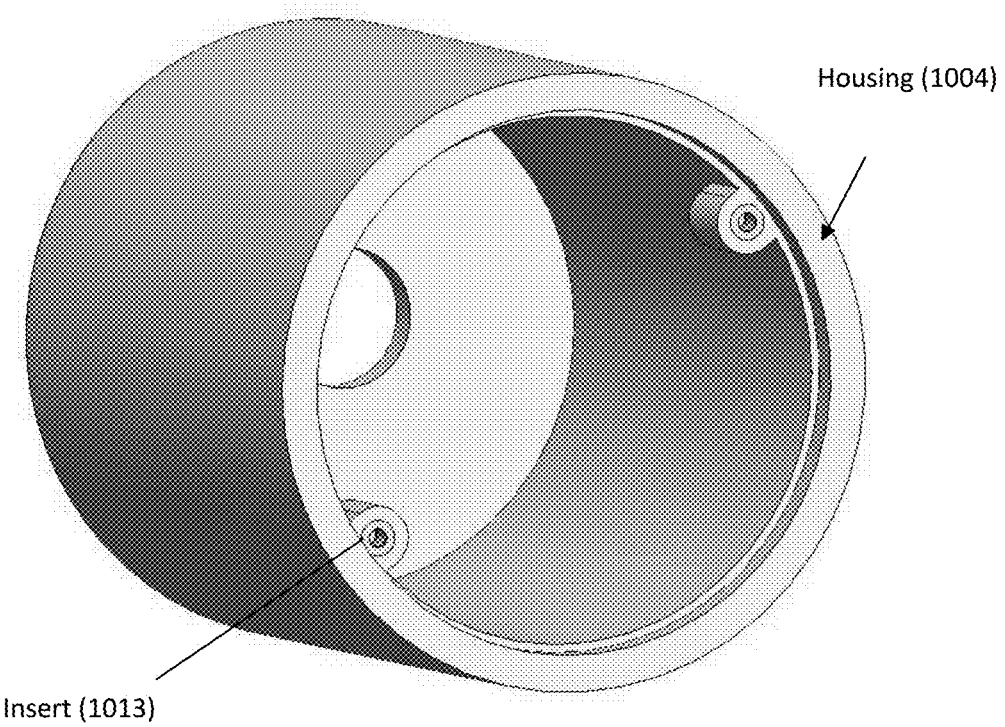
FIGS. 10A-10B illustrate perspective and exploded views of another embodiment of a housing for an electric candle having an outer wax or wax-like housing with inserts disposed within a portion of the housing.
Figure 10B:
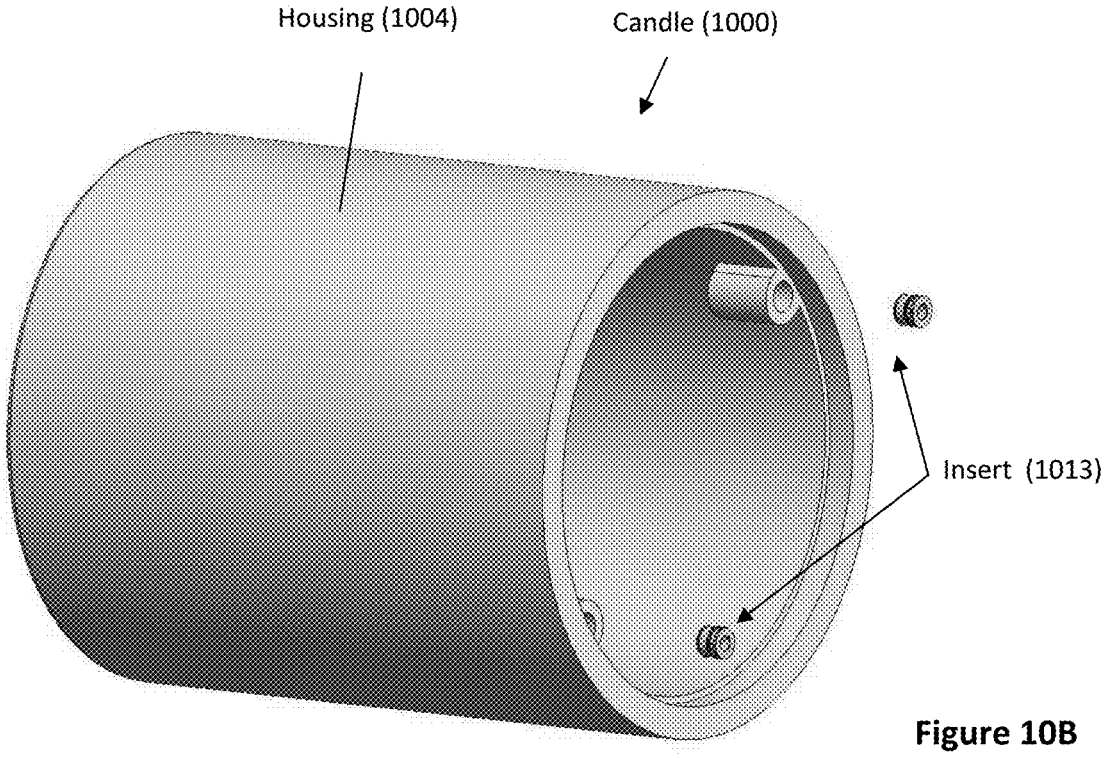

FIGS. 10A-10B illustrate a housing 1004 having one or more inserts 1013 that are disposed within the housing 10040. Although the inserts 1013 can be separately molded, it is preferred that the inserts are co-injection molded with the housing 1004. This advantageously eliminates the need for an inner housing, and saves on manufacturing and assembly costs. The inserts 1013 allow for a higher strength area than the wax or wax-like surface of the housing 1004 where additional structure or components can be coupled without requiring the entire housing to have a higher durability.

In other aspects, methods for injection molding of the housing are contemplated. Preferred methods utilize a wax material or a combination of a wax material and a plastic material to mold the housing.

Where multiple compositions are used, preferably a mixing head can be used prior to injection of the materials. As but one example, a mixture could include a 9:1 ratio of wax to plastic. Preferably, both the wax and plastic materials are heated to their respective melting points and then mixed together prior to injection. It is especially preferred that the mixture comprises at least 25% wax or a 3:1 ratio of plastic to wax.

In still further embodiments, the housing could be molded using a 100% wax material. In such embodiments, a spring-loaded mixing head is required to prevent run out of the wax material in between molds. Once molded, a large injector pin head can be used to separate the wax housing from the mold. Preferred injector pin heads are at least 50% of the surface area of one side of the housing, and sizes of 0.5 in, 1.0 in, and 2.0 inches are contemplated depending on the specific size of the candle housing.

As mentioned above in reference to FIG. 10, multiple plastic parts can be injection molding into the housing during this process to provide increased durability where separate parts will be coupled to the housing.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

What is claimed is:

1. A device used to form a wax shell for use with an electric lighting device, comprising:

a sleeve configured to define outer dimensions of an interior space;

a removable core configured to be inserted within the interior space to form a space between the sleeve and the core, wherein the space between the sleeve and the core is configured to receive wax to thereby form the wax shell, and wherein the core defines a hollow interior of the wax shell when the core is removed from the wax shell; and a modular top configured to be coupled to the sleeve, wherein a different top can be swapped out for the modular top to vary an upper surface of the wax shell;

a block disposed between the core and the modular top and configured to form an aperture in an upper surface of the wax shell.

2. The device of claim 1, further comprising an insert configured to vary an outer surface of the wax shell.

3. The device of claim 1, further comprising a top having a gate and a vent, wherein a hot wax can be inserted into the interior space via the gate.

4. The device of claim 3, wherein an excess wax can exit the interior space via the vent.

5. The device of claim 1, further comprising an ejector configured to eject the wax shell from the core once the wax shell is formed by applying force to the block.

6. The device of claim 1, wherein at least one of the core and sleeve is configured to receive a coolant.

7. The device of claim 1, wherein each of the core and sleeve is configured to receive a coolant.

8. The device of claim 6, wherein the coolant comprises water.

9. The device of claim 6, wherein at least one of the core and sleeve comprises a heat exchange that effects a heat exchange between the wax shell and the coolant.

10. The device of claim 1, wherein the core further comprises a keyway, such that the wax shell comprises a projection configured to guide insertion of a plastic core into the wax shell.

11. A method for forming wax shells, comprising:

providing a device having a sleeve that defines a hollow interior space, a core disposed within the interior space and that further defines the hollow interior space as the void between the sleeve and core, a modular top configured to be coupled to the sleeve, and a cap having a gate;

inserting the core within the interior space;

providing a block disposed between the core and the modular top, and configured to form an aperture in an upper surface of the wax shell; and feeding wax into the void of the interior space via the gate to form a wax shell with an aperture in an upper surface of the wax shell and having a hollow interior.

12. The method of claim 11, wherein the cap further comprises a vent through which excess wax can exit the interior space.

13. The method of claim 11, further comprising providing a manifold having at least one conduit, and wherein the step of feeding the wax into the interior space further comprises feeding the wax through the at least one conduit into the interior space via the gate.

14. The method of claim 13, wherein the wax is pressurized at a point when the wax enters the interior space.

15. The method of claim 13, wherein the manifold further comprises at least one guide configured to align the conduit with the gate.

16. The method of claim 13, further comprising automatically ejecting the wax shell from the interior space and disengaging the core from the device after the wax hardens.

17. The method of claim 13, further comprising feeding a cooling fluid into at least one of the core and sleeve to cause heat exchange between the wax and the at least one of the core and sleeve.

18. The method of claim 13, wherein the core further comprises a keyway.

* * * * *